United States Patent [19]

Dallaserra et al.

[11] Patent Number: 4,850,949

[45] Date of Patent: Jul. 25, 1989

[54] APPARATUS FOR FOLDING A BAND INTO ACCORDION PLEATS INCLUDING THREE PANELS

[75] Inventors: Arthur B. Dallaserra, Aulnay sous Bois; Gerard Saland, Ozoir la Ferriere, both of France

[73] Assignee: Herve et Fils SA, Paris, France

[21] Appl. No.: 77,898

[22] Filed: Jul. 27, 1987

[51] Int. Cl.[4] ..... B31F 1/00

[52] U.S. Cl. ..... 493/418; 493/233; 493/244; 493/450

[58] Field of Search ..... 493/233, 241, 244, 328, 493/397, 399, 401, 407, 410, 418, 423, 422, 450, 216, 230, 243, 249, 416, 436, 921; 270/39

[56] References Cited

U.S. PATENT DOCUMENTS

| | | | |
|---|---|---|---|
| 2,729,445 | 1/1956 | Webster | 270/39 |
| 4,095,695 | 6/1978 | Steidinger . | |
| 4,279,611 | 7/1981 | Labombarde et al. | 493/418 |
| 4,455,809 | 6/1984 | Dallaserra . | |
| 4,524,557 | 6/1985 | Silverman et al. . | |
| 4,586,703 | 5/1986 | McAnelly | 493/423 |
| 4,708,332 | 11/1987 | Besemann | 270/39 |

FOREIGN PATENT DOCUMENTS

| | | |
|---|---|---|
| 0051099 | 5/1982 | European Pat. Off. . |
| 2323612 | 4/1977 | France . |
| 2326249 | 4/1977 | France . |

*Primary Examiner*—Frederick R. Schmidt
*Assistant Examiner*—Robert Showalter
*Attorney, Agent, or Firm*—Sandler & Greenblum

[57] ABSTRACT

A method and apparatus for transferring a band at a predetermined speed V to a station for pre-marking two folding lines which define a central panel of each pleat and then subjecting the band over a short distance to abrupt deceleration to a speed V' such that $V'/V = 1/L$, where L is the length of each pleat in the fully extended state and 1 is the length of the pleat after folding so as to form a pocket, the last two panels of each pleat being inserted beneath the first panel prior to folding-back and maintaining the pocket in a flat position on the band.

21 Claims, 1 Drawing Sheet

F1
F2
F3

APPARATUS FOR FOLDING A BAND INTO ACCORDION PLEATS INCLUDING THREE PANELS

BACKGROUND OF THE INVENTION

1. Field of the Invention

This invention relates to stationery materials and office supplies, and specifically to envelopes which are to be sent to a large number of addresses, which may bear other personalized indications apart from addresses, and which are printed by the printing unit of a computer or of electrical counting equipment or the like.

2. Discussion of Background and Material Information

When a document, referred to hereinafter as a "folded sheet" or "insert", to be wrapped or enclosed in an envelope has sufficiently small dimensions, the format of the folded sheet is at most equal to the envelope format. In this case, the document sheet can be stacked at the time of manufacture as a continuous band together with two other bands which are intended to constitute respectively the top and bottom faces of the envelopes. The resultant continuous assembly of folded sheets, referred to herein as "mailers", are thus adapted for use in a conventional printing machine installed on the premises of the user which prints through the top band or layer of paper by means of conventional expedients, i.e., carbon zones, chemical papers, self-reproducers, and the like.

Alternatively, the assembly of bands may be performed on the premises of the user after passing the band of inserts through a printing machine such as the one described in French Application No. 76 29415, published as French Pat. No. 2,326,249, commonly owned with the present application.

It is also possible to form unitized inserts from the inserts on the premises of the user, which are adhesively bonded to the continuous band which is intended to form a back of the envelope as contemplated in French Application No. 75 27578, published as French Pat. No. 2,323,612, commonly owned with the present application, or as disclosed in U.S. Pat. No. 4,095,695.

Finally, with an insert which is slightly smaller than the envelope both in height and in width, unitization of inserts can be carried out on the premises of the user after printing and prior to insertion between the two bands constituting the front and rear faces of the envelope in accordance with a method which forms the subject of European Pat. No. 0,051,099, commonly owned with the present application. In the case just mentioned, it is possible prior to unitization of the inserts to fold the band of inserts in their longitudinal direction in half as stated in the patent cited above. In this case, each insert has a width greater than that of the envelope but remains of smaller height.

When the area of the insert is intended to be twice that of its envelope, the only means and methods presently known to accomplish this end involve the use of a conventional plate-type reciprocating or rotary folding machine followed by a pocket-forming machine after unitization of the inserts. However, although the transfer of the band of inserts within the printing machine can take place in increasingly higher speeds, i.e., up to 2400 m/h, the folding and pocket-forming operation cannot attain one-half this speed even with machines which are capable of the highest performances. It is consequently necessary to provide a plurality of these machines.

SUMMARY OF THE INVENTION

The present invention is directed to a method for folding a band into a continuous assembly of accordion pleats including at least three panels which involves displacing the band at a predetermined speed V within a station for pre-marking at least two fold lines to define a central panel of each of the pleats; deaccelerating the band to a speed V', such that $V'/V=1/L$, wherein L is the length of each pleat in the fully extended state and 1 is the length of the pleat after folding so as to form a pocket; and folding-back and maintaining the pocket in a flat position on the band.

The method of the present invention also involves inserting a last panel and a next-to-last panel of each of the pleats beneath a first panel of each of the pleats, as well as pre-marking folding lines to define the central panel of each pleat, preferably wherein the pre-marking operation involves formation of supplying lines performed by a physico-chemical process, such as linear coating with a commercially available solvent.

In addition, the present invention is directed to a method for folding a band into a continuous assembly of accordion pleats, as described above, which also involves subjecting the band to a longitudinal folding operation prior to transferring the folded band to a station for pre-marking folding lines of each of the pleats.

The present invention is also directed to an apparatus for converting a continuous band having a margin with perforations to a continuous assembly of three-panel accordion pleats which includes a conveyor including conveyor belts extending between two studded feed units attached to cooperate with such perforations of the band; a studded feed unit located at a feed end of the conveyor adapted to travel at a predetermined speed V; another studded feed unit located at the discharge end of the conveyor adapted to travel at a speed V', such that $V'/V=1/L$, wherein L is the length of the pleats in a fully extended state and 1 is the length of the pleats after folding along the two transverse lines of the pleat, preferably wherein the conveyor belts include two lateral belts driven at the speed V' from one end of the conveyor to another end of the conveyor, a plurality of central belts attached around an intermediate shaft, and an upstream set of belts driven at the speed V, and a downstream set of belts driven at the speed V', preferably wherein the upstream set of central belts includes slotted belts cooperatively associated with a suction system on at least part of their travel except at the level of a blowing unit.

In addition, the apparatus of the present invention also includes two wheels respectively applied upstream of the intermediate shaft against top faces of the lateral belts adapted to cooperate with the lateral belts so as to constitute a regulator which coordinates a feed motion of the band with a deacceleration of the band so as to cause the band to form a pocket.

Additionally, the apparatus of the present invention also includes a folding-back unit for forming a pocket and laying the pocket against the band prior to engagement beneath the wheels.

Further, the apparatus of the present invention includes a station upstream of the conveyor for mechanical or physico-chemical pre-marking of two transverse folding lines to define a central panel of each of the pleats.

The apparatus of the present invention, as described above, also includes an upwardly-directed sequential blowing unit located upstream of the regulator to assist the formation of the pockets.

BRIEF DESCRIPTION OF THE DRAWINGS

A more complete understanding of the invention will be gained from the description given below, reference being made to the accompanying drawings, wherein.

DETAILED DESCRIPTION

Figures 1, 2:
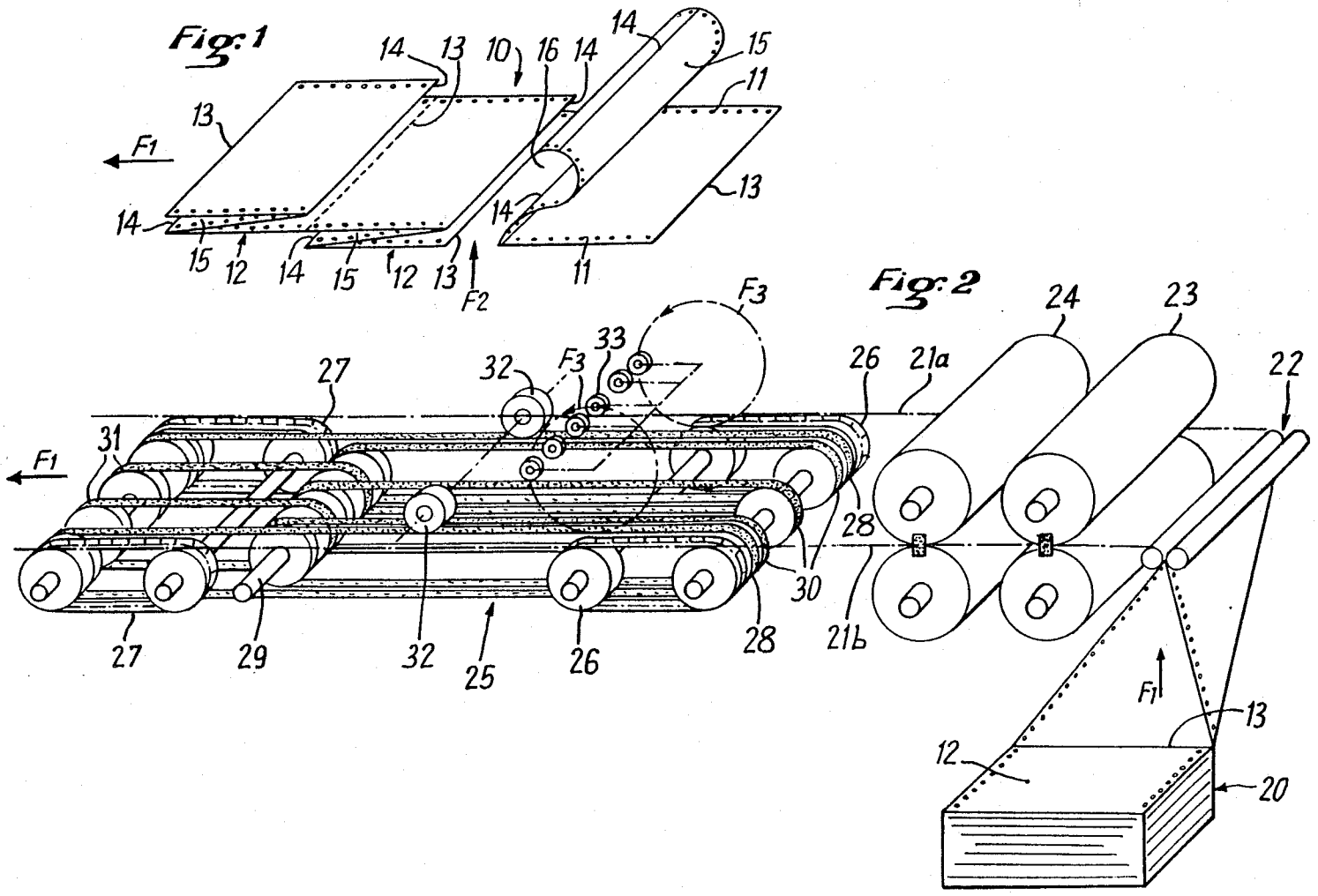
FIG. 1 is a perspective view showing a segment of band folded in accordance with the method claimed.
FIG. 2 is a schematic perspective diagram of a machine for carrying out the folding operation shown in FIG. 1.
Figures 1, 2:
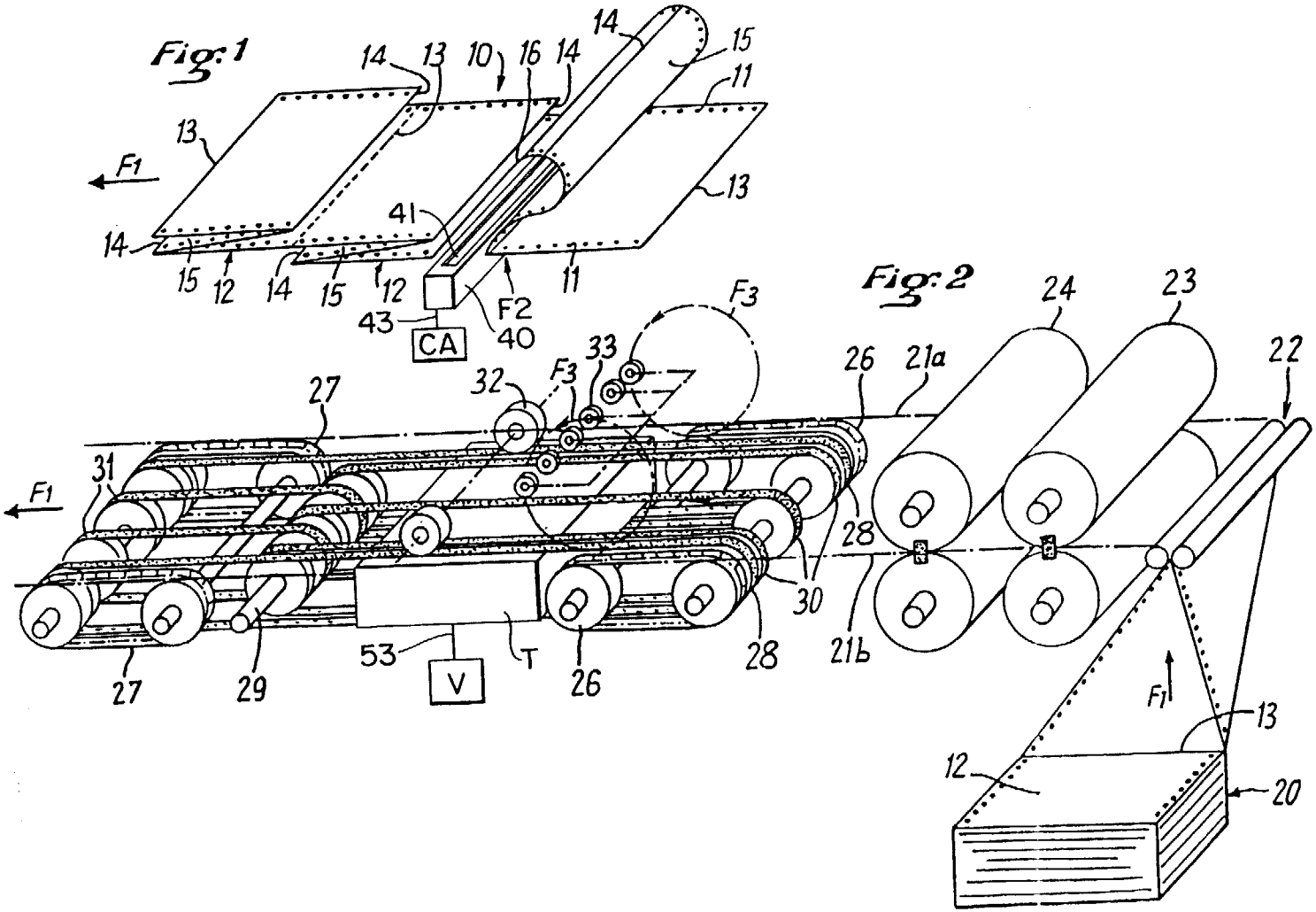

The present invention is directed to a method for accordion-folding each insert after passing the insert through the printer but prior to unitization in order to ensure that the height of the insert is at most equal to the height of the envelope. The folding operation is performed along two transverse lines of each insert, if necessary after longitudinal folding of the continuous band of inserts. The unfolded insert then has an area which may amount to as much as three times the area of the envelope, i.e., or six times the area in the event of longitudinal folding. The band of inserts thus folded or "pleated" is then assembled with the bands of the front and back envelopes facing in a conventional manner so as to constitute a continuous assembly of folded sheets.

Alternatively, each folded insert may be introduced after unitization between the two bands of the front and back envelope faces in accordance with European Pat. No. 0,051,099 and its corresponding U.S. Application No. 204,815, filed Nov. 7, 1980, now U.S. Pat. No. 4,455,809, the disclosure of which is hereby incorporated by reference thereto.

In order to obtain the previously described pleating of the band of inserts, a method has been developed which involves displacing the band on a conveyor-belt at a predetermined speed V which can be imposed by a machine placed upstream, such as a printing machine, to mark the two folding lines on each insert, then abruptly decelerating the feed motion to a speed V′ of approximately V/3 in order to obtain a wavy band corrugation in the form of a pocket. To this end, means are provided for folding-back the pocket flat against the conveyor-belt.

The pocket can be folded-back in the upstream or downstream direction, depending on the subsequent forming operations. As a general rule, however, the folding-back operation will be performed in the upstream direction in order to ensure that the last and next-to-last panels of the insert come into position beneath the first panel. In so doing, engagement of the pleated band is facilitated within the stationary elements of the various forming stations which follow, thereby virtually eliminating any potential danger of jamming.

The present invention is also directed to an apparatus for a practical operation of the method. Assuming that conventional stations are provided for longitudinal folding and for marking transverse folding lines, the apparatus in accordance with the invention includes a belt conveyor located downstream of such stations, a first studded feed unit located at the feed end of the conveyor and driven at a speed V, a second studded feed unit located at the discharge end of the conveyor and driven at a speed V′ such that $V'/V = l/L$, where l is the length of the pleated insert and L is the length in the fully extended state. The conveyor belts are preferably perforated or slotted and are distributed in such a manner as to provide two lateral belts which are driven at the speed V′ from one end of the conveyor to the other. A plurality of central belts formed around an intermediate shaft including an upstream set of belts driven at the speed V and a downstream set of belts driven at the speed V′. Two wheels located upstream of the intermediate shaft are applied respectively against the top face of the lateral belts and constitute a regulator which coordinates the feed motion of the band at the moment of deceleration. An upwardly directed sequential blowing unit located upstream of the regulator has a function of lifting the band so as to form a pocket, the bottom of which corresponds to the folding line located between the first and the second panel of the insert which arrives in this zone. Finally, a folding-back unit has the intended function of laying said pocket against the band.

The previously described aspects of the present invention will now be described with respect to the annexed drawing illustrating a preferred embodiment of the present invention.

In FIG. 1, a band 10, provided with sprocket feed holes shown as perforations 11 along its two lateral margins, is a continuous band of printed sheets 12 separated from each other by a transverse line 13 of detachable perforations and/or folding perforations. In accordance with conventional practice, a band of this type is delivered to the user with accordion folds formed along transverse lines 13 in the form of a pocket of the type shown in FIG. 2 and designated as stack 20.

When each printed sheet 12 is a document to be inserted in an envelope and has an area which is larger than that of the envelope, it has to be folded, i.e., in accordion folds, rolled folds or crossed folds. Until the present invention, this operation required the use of a rotary or reciprocating plate-type folding machine after unit formation. A disadvantage of the conventional folding machine is that the production rates achieved even by machines which operate at the highest speeds are not favorably comparable with the production rates of machines for the production of printed sheets, i.e., conventional printers or computer printers.

The present invention, therefore, generally involves folding each printed sheet prior to unitization in order to obtain a continuous band of folded printed sheets. However, it is necessary to limit this operation to folding each printed sheet in a three-panel accordion, if necessary after a conventional longitudinal folding operation.

The method of the present invention, therefore, involves moving the band at a predetermined speed V first into a station for pre-marking the two transverse folds 14 which define a central panel 15, then onto a conveyor on which the band is subjected over a short distance to a sharp deceleration to a speed V′ of approximately V/3 in order to form a pocket 16 and for the last panels of each printed sheet to slip beneath the first panel, means being provided for folding-back and holding the pocket on the conveyor in a flat position.

If the three panels of each printed sheet are of equal height, the speed V′ of the band will be $V' = V/3$. If the panels are of unequal height, then the value V′ will be such that the rate of travel of the paper of the pleated band will substantially remain the same as the rate of travel of the band in the fully extended state. In other words, V' will be such that $V'/V=1/L$, where 1 is the length of the accordion-folded insert and L is the length of said insert in the extended state.

Marking of the transverse folds 14 can be performed mechanically by grooving, perforating, or scoring, for example, but also by forming weakened tear lines with the aid of a physico-chemical agent. The physico-chemical folding operation is preferably carried out, for example, by linear coating with a commercially available solvent.

A schematic perspective view of a device for the practical application of the method in accordance with the invention is illustrated in FIG. 2. The band which is shown in this figure and the direction of forward travel which is indicated by the arrows $F_1$ is illustrated at the point of entry of the band at the upstream end of the device, but is simply represented by two chain-dotted lines $\mathbf{21}_a$ and $\mathbf{21}_b$ on its path of travel within the device.

The band is delivered to the device in the form of a stack or packet 20 which is folded into an accordion configuration along transverse lines 13. A printed sheet 12 is defined by two successive transverse lines 13. In the example shown, the first station 22 of the device is a conventional longitudinal folding station. In this case, the band is subsequently driven only on one of its edges unless provision is made for a double line of driving perforations on each side of the longitudinal median line.

The band then passes into a station 23 and 24 for pre-marking the transverse folds 14 of each printed sheet 12.

It will be readily understood that the rollers of the longitudinal folding station 22 and the rollers of the station 23, 24 for marking folds 14 rotate at essentially the same tangential velocity V which is equal to the rate of travel of a studded feed unit 26 placed at the feed end of a belt conveyor which is generally designated by the reference 25. In the case of a band provided with sprocket feed holes on each lateral edge, provision will accordingly be made for two studded feed units 26 keyed on the same drive shaft. The speed V can be imposed by a machine located upstream when the band 10 is fed directly from this machine and not in the form of packets 20.

At the discharge end of the belt conveyor 25, a second studded feed unit 27 travels at a speed V' such that $V'/V=1/L$, where 1 is the length of the printed and accordion-folded sheet along the two lines 14, and L is the length of the printed sheet in the completely flat state. If the three panels are equal, the rate of travel will be $V'=V/3$.

Between the two studded feed units 26 and 27, the band rests on belts which are preferably slotted. The conveyor belts include two lateral belts 28 driven at the speed V' from one end of the conveyor to the other and a plurality of central belts which form, by means of an intermediate shaft 29, an upstream set of belts 30 driven at the speed V and a downstream set of belts 31 driven at the speed V'.

Upstream of the intermediate shaft 29, two wheels 32 respectively applied against the top faces of the lateral belts 28 are adapted to cooperate with the lateral belts so as to constitute a regulator which coordinates the feed motion of the band at the time of deceleration.

On the upstream side of the regulator 32 and within the deceleration zone, an upwardly-directed sequential blowing unit represented schematically by $F_2$ in FIG. 1 has the function of lifting the band upwardly in the direction of the arrow so as to form a pocket 16, the bottom portion of which corresponds to the folding line 14 located between the first and second panels of the printed sheet concerned. The blower or blowing unit $F_2$ is illustrated as a transverse manifold 40 or tube having a vent 41 for expelling compressed air extending along the longitudinal axis of the manifold. As shown schematically the manifold is connected by a conduit 43 to a source of compressed air CA. Alternatively, the compressed air may be supplied by a series of ducts or nozzles (not shown) connected to the compressed air source positioned transversely across the path of the bands in a manner similar to the manifold.

The last panel of the printed sheet arrives at the speed V such that the first panel cannot exert a forward thrust on the last panel of the previous printed sheet which is already subjected to the action of the regulator 32. Accordingly, the last panel engages beneath the first panel and is accompanied by the second panel.

A folding-back unit, composed in this case of a plurality of small wheels 33 mounted on the pin of a crank, having the path of travel indicated schematically by the circular arrows $F_3$ accordingly lays the pocket against the band prior to engagement beneath the wheels 32. It should be noted that each revolution of the folding-back unit corresponds to the forward displacement of one insert. In other words, the number N of revolutions of the folding-back unit per unit of time is equal to V/L.

Advantageously, the central belts 30 of the upstream set are perforated or provided with a suction system on at least part of their path of travel except at the level of the blowing unit in order to ensure that the band is maintained in a completely flat state on the conveyor both before and after pleating. The suction system is conventional in design and is shown schematically in FIG. 2. In this regard, the suction system includes a manifold or table over which the perforated or slotted belts pass. The top surface of the manifold of the suction system is provided with a series of orifices, slots or a continuous vent (not shown) positioned along a longitudinal axis under each belt. The manifold is illustrated schematically as a parallelpipedic case connected by means of a conduit or suction pipe 53 to a source of a vacuum V to provide suction. The vent, however, is preferably interrupted under the belts in the vicinity of the previously described blowing unit $F_2$. Thus, when the suction system is activated, the bands are drawn against the belts in the area above the vent.

At the discharge end of the conveyor 25, the pleated band is carried into the different conventional forming stations for finishing operations, such as edge cutting, in addition to insertion between two bands constituting the top and bottom envelope faces after or prior to unitization by rupture or cutting.

As stated earlier, the method claimed herein is primarily intended to permit high-speed envelope-forming operations. It will be readily apparent, however, that this particular band-forming process can have other potential applications without thereby departing either from the scope or the spirit of the invention.

Although the invention has been described with reference to particular means, materials and embodiments, it is to be understood that the invention is not limited to the particulars disclosed, but extend to all equivalents within the scope of the claims. Thus, from the foregoing description one skilled in the art can easily ascertain the essential characteristics of the invention and without departing from the spirit and scope thereof, can make various changes and modifications of the invention and adapt it to various usages and conditions.

What is claimed is:

1. An apparatus for converting a continuous band having a margin with perforations to a continuous assembly of three-panel accordion pleats comprising:

A) a conveyor including conveyor belts extending between feed units;

B) a first feed unit having studs adapted to cooperate with said perforations in said band located at a feed end of said conveyor adapted to travel at a predetermined speed V;

C) another feed unit having studs adapted to cooperate with said perforations in said band located at the discharge end of the conveyor adapted to travel at a speed V' such that $V'/V=1/L$, wherein L is the length of a three-panel pleat in a fully extended state and 1 is the length of said pleat after folding along two transverse lines to form said pleat; and D) means for forming a pocket in said band operably associated with said conveyor belts.

2. An apparatus for converting a continuous band having a margin with perforations to a continuous assembly of three-panel accordion pleats comprising:

A) a conveyor including conveyor belts extending between feed units, said conveyor belts including:

a) two lateral belts driven at a speed V' from one end of said conveyor to another end of said conveyor, and b) a plurality of central belts attached around an intermediate shaft including:

i) an upstream set of central belts driven at a speed V, and ii) a downstream set of central belts driven at the speed V';

B) a first feed unit having studs adapted to cooperate with said perforations of said band located at a feed end of said conveyor adapted to travel at the predetermined speed V;

C) another feed unit having studs adapted to cooperate with said perforations of said band located at the discharge end of the conveyor adapted to travel at the speed V' such that $V'/V=1/L$, wherein L is the length of a three-panel pleat in a fully extended state and 1 is the length of said pleat after folding along two transverse lines to form said pleat; and D) means for forming a pocket in said band operably associated with said lateral belts.

3. The apparatus for converting a continuous band having a margin with perforations to a continuous assembly of three-panel accordion pleats in accordance with claim 2, further comprising:

E) two wheels respectively applied upstream of the intermediate shaft against top faces of said lateral belts adapted to cooperate with said lateral belts so as to constitute a regulator which coordinates a feed motion of said band with a deceleration of said band to assist in the formation of said pocket.

4. The apparatus for converting a continuous band having a margin with perforations to a continuous assembly of three-panel accordion pleats in accordance with claim 10, wherein said means for forming a pocket comprises:

a folding-back unit operably associated with said two lateral belts and said upstream set of belts for forming a pocket and laying said pocket against said band prior to engagement beneath said two wheels.

5. The apparatus for converting a continuous band having a margin with perforations to a continuous assembly of three-panel accordion pleats in accordance with claim 4 further comprising:

F) a pre-marking station upstream of said conveyor for pre-marking two transverse folding lines to define a central panel of each of the pleats.

6. The apparatus for converting a continuous band having a margin with perforations to a continuous assembly of three-panel accordion pleats in accordance with claim 5, wherein said pre-marking station includes means for mechanically pre-marking said transverse folding lines.

7. The apparatus for converting a continuous band having a margin with perforations to a continuous assembly of three-panel accordion pleats in accordance with claim 5, wherein said pre-marking station includes means for physicochemical pre-marking said transverse folding lines.

8. The apparatus for converting a continuous band having a margin wth perforations to a continuous assembly of three-panel accordion pleats in accordance with claim 5, comprising:

G) a longitudinal-folding station upstream of said pre-marking station for folding said panel longitudinally prior to pre-marking with said transverse folding lines.

9. The apparatus for converting a continuous band having a margin with perforations to a continuous assembly of three-panel accordion pleats in accordance with claim 8, further comprising:

H) an upwardly-directed sequential blowing unit located upstream of said regulator adjacent said folding-back unit to assist the forming of said pockets.

10. The apparatus for converting a continuous band having a margin with perforations to a continuous assembly of three-panel accordion pleats in accordance with claim 9, wherein said upstream set of central belts comprise slotted belts cooperatively associated with a suction system on at least part of their travel except at the level of said blowing unit.

11. The apparatus for converting a continuous band having a margin with perforations to a continuous assembly of three-panel accordion pleats in accordance with claim 4, comprising:

F) a longitudinal-folding station upstream of said folding-back unit for folding said panel longitudinally prior to forming said pocket.

12. The apparatus for converting a continuous band having a margin with perforations to a continuous assembly of three-panel accordion pleats in accordance with claim 11, further comprising:

G) an upwardly-directed sequential blowing unit located upstream of said regulator adjacent said folding-back unit to assist the formation of said pockets.

13. The apparatus for converting a continuous band having a margin with perforations to a continuous assembly of three-panel accordion pleats in accordance with claim 12, wherein said upstream set of central belts comprise slotted belts cooperatively associated with a suction system on at least part of their travel except at the level of said blowing unit.

14. The apparatus for converting a continuous band having a margin with perforations to a continuous assembly of three-panel accordion pleats in accordance with claim 4, further comprising:

F) an upwardly-directed sequential blowing unit located upstream of said regulator adjacent said folding-back unit to assist the formation of said pockets.

15. The apparatus for converting a continuous band having a margin with perforations to a continuous assembly of three-panel accordion pleats in accordance with claim 14, wherein said upstream set of central belts comprise slotted belts cooperatively associated with a suction system on at least part of their travel except at the level of the blowing unit.

16. The apparatus for converting a continuous band having a margin with perforations to a continuous assembly of three-panel accordion pleats in accordance with claim 14, wherein said upstream set of central belts comprise belts provided with orifices cooperatively associated with a suction system on at least part of their travel except at the level of said blowing unit.

17. The apparatus for converting a continuous band having a margin with perforations to a continuous assembly of three-panel accordion pleats in accordance with claim 5, further comprising:

G) an upwardly-directed sequential blowing unit located upstream of said regulator to assist the formation of said pockets.

18. The apparatus for converting a continuous band having a margin with perforations to a continuous assembly of three-panel accordion pleats in accordance with claim 17, wherein said upstream set of central belts comprise belts provided with orifices cooperatively associated with a suction system on at least part of their travel.

19. The apparatus for converting a continuous band having a margin with perforations to a continuous assembly of three-panel accordion pleats in accordance with claim 8, further comprising an upwardly-directed sequential blowing unit located upstream of said regulator to assist the formation of said pockets.

20. The apparatus for converting a continuous band having a margin with perforations to a continuous assembly of three-panel accordion pleats in accordance with claim 19, wherein said upstream set of central belts comprise belts provided with orifices cooperatively associated with a suction system on at least part of their travel except at the level of the blowing unit.

21. The apparatus for converting a continuous band having a margin with perforations to a continuous assembly of three-panel accordion pleats in accordance with claim 9, wherein said upstream set of central belts comprising belts provided with orifices cooperatively associated with a suction system on at least part of their travel except at the level of the blowing unit.

* * * * *

UNITED STATES PATENT AND TRADEMARK OFFICE

CERTIFICATE OF CORRECTION

PATENT NO. : 4,850,949

DATED : July 25, 1989

INVENTOR(S) : Arthur DALLASERRA et al.

It is certified that error appears in the above-identified patent and that said Letters Patent is hereby corrected as shown below:

The title page should be deleted to appear as per attached title page.

The attached sheet of drawings is being substituted for the sheet of drawings as it appears in the printed patent.

The title page of the printed patent should read
---Foreign Application Priority Data
August 12, 1986 [EPO] 86.401802.3---.
At column 7, line 67, claim 4, line 4, change "10" to ---3---.

Signed and Sealed this

Twenty-second Day of May, 1990

*Attest:*

HARRY F. MANBECK, JR.

*Attesting Officer*

*Commissioner of Patents and Trademarks*

United States Patent [19]

Dallaserra et al.

[11] Patent Number: 4,850,949

[45] Date of Patent: Jul. 25, 1989

[54] APPARATUS FOR FOLDING A BAND INTO ACCORDION PLEATS INCLUDING THREE PANELS

[75] Inventors: Arthur B. Dallaserra, Aulnay sous Bois; Gerard Saland, Ozoir la Ferriere, both of France

[73] Assignee: Herve et Fils SA, Paris, France

[21] Appl. No.: 77,898

[22] Filed: Jul. 27, 1987

[51] Int. Cl.[4] ..... B31F 1/00

[52] U.S. Cl. ..... 493/418; 493/233; 493/244; 493/450

[58] Field of Search ..... 493/233, 241, 244, 328, 493/397, 399, 401, 407, 410, 418, 423, 422, 450, 216, 230, 243, 249, 416, 436, 921; 270/39

[56] References Cited

U.S. PATENT DOCUMENTS

| | | | |
|---|---|---|---|
| 2,729,445 | 1/1956 | Webster | 270/39 |
| 4,095,695 | 6/1978 | Steidinger . | |
| 4,279,611 | 7/1981 | Labombarde et al. | 493/418 |
| 4,455,809 | 6/1984 | Dallaserra . | |
| 4,524,557 | 6/1985 | Silverman et al. . | |
| 4,586,703 | 5/1986 | McAnelly | 493/423 |
| 4,708,332 | 11/1987 | Besemann | 270/39 |

FOREIGN PATENT DOCUMENTS

| | | |
|---|---|---|
| 0051099 | 5/1982 | European Pat. Off. . |
| 2323612 | 4/1977 | France . |
| 2326249 | 4/1977 | France |

*Primary Examiner*—Frederick R. Schmidt
*Assistant Examiner*—Robert Showalter
*Attorney, Agent, or Firm*—Sandler & Greenblum

[57] ABSTRACT

A method and apparatus for transferring a band at a predetermined speed V to a station for pre-marking two folding lines which define a central panel of each pleat and then subjecting the band over a short distance to abrupt deceleration to a speed V' such that $V'/V = l/L$, where L is the length of each pleat in the fully extended state and l is the length of the pleat after folding so as to form a pocket, the last two panels of each pleat being inserted beneath the first panel prior to folding-back and maintaining the pocket in a flat position on the band.

21 Claims, 1 Drawing Sheet

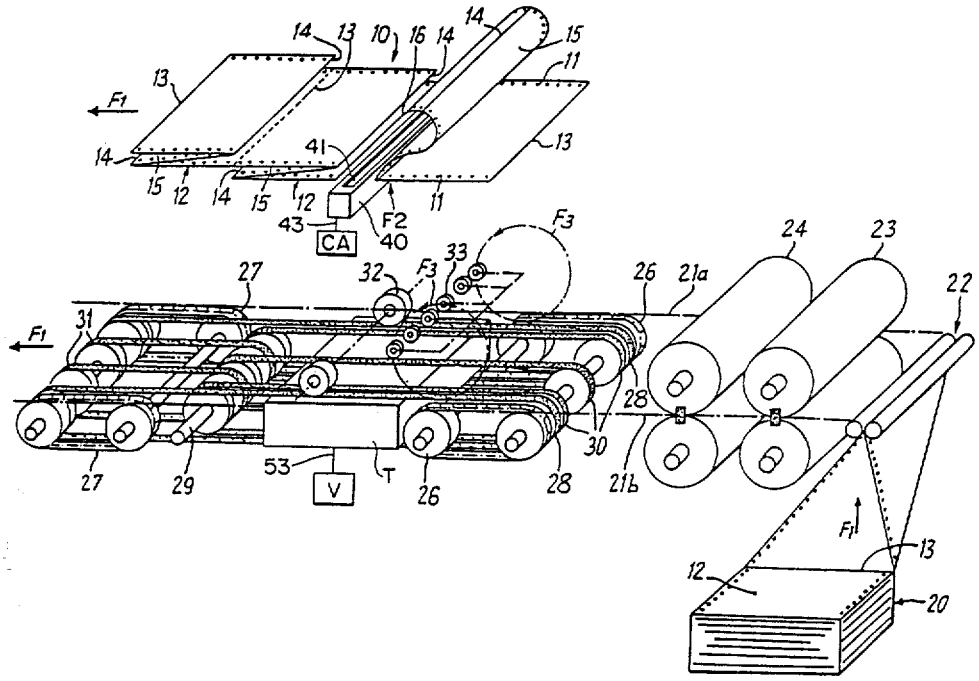

CA
V
F1
F2
F3
T